US011015288B2

(12) United States Patent
Nakayama et al.

(10) Patent No.: US 11,015,288 B2
(45) Date of Patent: May 25, 2021

(54) GRAINED ARTIFICIAL LEATHER

(71) Applicant: KURARAY CO., LTD., Kurashiki (JP)

(72) Inventors: Kimio Nakayama, Okayama (JP); Naoto Narumoto, Okayama (JP)

(73) Assignee: KURARAY CO., LTD., Kurashiki (JP)

( * ) Notice: Subject to any disclaimer, the term of this patent is extended or adjusted under 35 U.S.C. 154(b) by 164 days.

(21) Appl. No.: 16/097,514

(22) PCT Filed: Apr. 28, 2017

(86) PCT No.: PCT/JP2017/016956

§ 371 (c)(1),
(2) Date: Oct. 29, 2018

(87) PCT Pub. No.: WO2017/195661

PCT Pub. Date: Nov. 16, 2017

(65) Prior Publication Data

US 2019/0153666 A1 May 23, 2019

(30) Foreign Application Priority Data

May 9, 2016 (JP) ..... JP2016-093628

(51) Int. Cl.

| | |
|---|---|
| ***D06N 3/00*** | (2006.01) |
| ***D06M 13/285*** | (2006.01) |
| ***D06M 11/45*** | (2006.01) |
| ***D06M 11/44*** | (2006.01) |
| ***D06M 13/224*** | (2006.01) |
| ***D06M 13/288*** | (2006.01) |
| ***D06M 23/08*** | (2006.01) |

(52) U.S. Cl.

CPC ..... *D06N 3/0004* (2013.01); *D06M 11/44* (2013.01); *D06M 11/45* (2013.01); *D06M 13/224* (2013.01); *D06M 13/285* (2013.01); *D06M 13/288* (2013.01); *D06M 23/08* (2013.01); *D06N 3/00* (2013.01); *D06N 3/0036* (2013.01); *D06N 3/0063* (2013.01); *D06N 2209/067* (2013.01); *D06N 2211/28* (2013.01); *D10B 2331/04* (2013.01)

(58) Field of Classification Search

None

See application file for complete search history.

(56) References Cited

U.S. PATENT DOCUMENTS

| | | | |
|---|---|---|---|
| 2008/0166559 | A1 | 7/2008 | Schwarzbach et al. |
| 2009/0258182 | A1 | 10/2009 | Okamoto et al. |
| 2016/0002846 | A1 | 1/2016 | Yoshimoto et al. |

FOREIGN PATENT DOCUMENTS

| | | | |
|---|---|---|---|
| EP | 1 375 730 | A1 | 1/2004 |
| EP | 1 916 329 | A1 | 4/2008 |
| JP | 7-150478 | A | 6/1995 |
| JP | 2007-16357 | A | 1/2007 |
| JP | 2007-118497 | A | 5/2007 |
| JP | 2009-209489 | A | 9/2009 |
| JP | 2016-44375 | A | 4/2016 |
| TW | I372806 | B | 9/2012 |
| WO | WO2014/132630 | A1 | 9/2014 |
| WO | WO2014/208685 | A1 | 12/2014 |

OTHER PUBLICATIONS

International Search Report dated Jul. 18, 2017, in PCT/JP2017/016956, filed Apr. 28, 2017.

Extended European Search Report dated Dec. 2, 2019 in European Patent Application No. 17796022.6, 9 pages.

Zhengxi, W., et al.. "Analytical methods and applications of polymeric materials", Shanghai Science and Technology Publishing Company,1st edition, Jan. 31, 2009, pp. 341, 350 (with unedited computer generated English translation).

*Primary Examiner* — Shawn Mckinnon

(74) *Attorney, Agent, or Firm* — Oblon, McClelland, Maier & Neustadt, L.L.P.

(57) ABSTRACT

Disclosed is a grain-finished artificial leather including: an artificial leather base material; and a resin layer stacked on at least one surface of the artificial leather base material, wherein the artificial leather base material contains: a fiber-entangled body of ultrafine fibers; 3 to 50 mass % of a first elastic polymer; 2.5 to 6 mass %, in terms of phosphorus atoms, of first phosphorous-based flame retardant particles having an average particle size of 1 to 10 μm; and 1 to 6 mass % of a plasticizer, and the resin layer contains: a second elastic polymer; and a total content, in terms of phosphorus atoms or in terms of hydroxyl groups, of 0 to 8 mass % of flame retardant particles having an average particle size of 1 to 10 μm and being at least one selected from the group consisting of second phosphorous-based flame retardant particles and first metal hydroxide particles.

20 Claims, No Drawings

GRAINED ARTIFICIAL LEATHER

TECHNICAL FIELD

The present invention relates to a grain-finished artificial leather having both a high level of flame retardancy and an excellent texture.

BACKGROUND ART

Conventionally, a grain-finished artificial leather is known in which a grain-like resin layer is stacked on an artificial leather base material obtained by impregnating an elastic polymer into a fiber-entangled body, such as a non-woven fabric, of ultrafine fibers. The grain-finished artificial leather has been used as an alternative to a natural leather for the materials of shoes, clothing, gloves, bags, balls, and the like, and the interior materials for buildings and vehicles.

Natural leather includes dense collagenous fibers, and thus has both suppleness and a high level of fullness (voluminousness). When natural leather is bent, such a high level of fullness allows the formation of fine luxurious fold creases with roundness, and also achieves elegant drape. However, it has been difficult to obtain a natural leather with stable quality. Since the collagenous fibers have low heat resistance and low water resistance, it has been difficult for natural leather to be used in applications for which heat resistance or high water resistance are required. To impart heat resistance or high water resistance to natural leather, a method is available in which a thick resin layer is formed on the surface of the leather. However, when a thick resin layer is formed, the suppleness of the natural leather would be lost.

On the other hand, the grain-finished artificial leather is superior to natural leather in quality stability, heat resistance, water resistance, and abrasion resistance, and is also easier to maintain. However, voids that are not packed with an elastic polymer remain inside the fiber-entangled body of the grain-finished artificial leather, and, therefore, the grain-finished artificial leather is inferior to natural leather in fullness. Therefore, when bent, the grain-finished artificial leather does not bend with roundness as with the natural leather, and, instead, bends sharply as if in breaking. There is no luxurious quality to this kind of bending. When the number of voids is decreased by increasing the content ratio of the elastic polymer in the fiber-entangled body, the resilience of the elastic polymer increases, resulting in a rubber-like, rigid texture. As a grain-finished artificial leather having a texture similar to that of natural leather, for example, PTL 1 listed below discloses a grain-finished artificial leather with a high level of fullness that is obtained by stacking a grain-like resin layer on an artificial leather base material containing a filler, a liquid non-volatile oil, and an elastic polymer.

Meanwhile, in recent years, leather-like sheets such as artificial leather sheets and synthetic leather sheets have been used as the interior materials for public transports such as aircrafts, vessels, and railroad vehicles, and the interior materials for public buildings such as hotels and department stores. The materials of interior materials and the like that are used in public places are required have a high level of flame retardancy such as self-extinguishing properties, low smoke generation, and low heat generation in order to ensure safety in the event of a fire. In order to meet such flame retardancy requirements, halogen-based flame retardants having high flame retardancy performance have hitherto been widely blended in the materials such as interior materials. However, halogen-based flame retardants generate a toxic halogen gas when burned. Therefore, in recent years, public organizations and users with environmental considerations have recommended that halogen-based flame retardants not be used. In order to respond to such a request, various techniques using a phosphorous-based flame retardant and a metal hydroxide-based flame retardant have been proposed. For example, PTL 2 listed below discloses a fiber-urethane resin stack including, on at least one side of a fiber fabric, an adhesive layer made of a urethane resin containing a metal salt of dialkyl phosphinic acid, and a skin layer made of a urethane resin that is provided on the adhesive layer. In addition, PTL 3 listed below discloses a synthetic leather including a base material layer made of a non-woven fabric or a knitted or woven fabric, an adhesive layer stacked on the base material layer, and a skin layer stacked on the adhesive layer, wherein 17 $g/m^2$ or more and 90 $g/m^2$ or less of a flame retardant is contained in the adhesive layer, and the glass transition temperature (Tg) of a resin forming the adhesive layer is −20° C. or less.

CITATION LIST

Patent Literatures

[PTL 1] WO 2014/132630 pamphlet
[PTL 2] Japanese Laid-Open Patent Publication No. 2007-118497
[PTL 3] WO 2014/208685 pamphlet

SUMMARY OF INVENTION

Technical Problem

A grain-finished artificial leather that uses an artificial leather base material obtained by impregnating an elastic polymer into voids inside a fiber-entangled body of ultrafine fibers is characterized by being superior in suppleness and fullness to a synthetic leather including a knitted or woven fabric of fibers of about 1 to 5 dtex, which are also called regular fibers, as the base material. However, a fiber-entangled body of densely entangled ultrafine fibers has a significantly large surface area as compared with a knitted or woven fabric of regular fibers, and thus is flammable. An elastic polymer that has been added into a grain-like resin layer or a fiber-entangled body is more flammable than the resin forming the fibers. For these reasons, it has been difficult for a grain-finished artificial leather containing a large amount of an elastic polymer to be made flame-retardant, and in particular, it has been difficult to impart high flame retardancy to the grain-finished artificial leather without blending a halogen flame retardant therein. When high flame retardancy is imparted to the grain-finished artificial leather by using a large amount of a non-halogen-based flame retardant, a texture such as suppleness and fullness, which is characteristic to a grain-finished artificial leather that uses an artificial leather base material including a fiber-entangled body of ultrafine fibers, are impaired.

It is an object of the present invention to provide a grain-finished artificial leather having both a high level of flame retardancy and an excellent texture by using a non-halogen-based flame retardant in a grain-finished artificial leather that uses an artificial leather base material including a fiber-entangled body of ultrafine fibers.

Solution to Problem

An aspect of the present invention is directed to a grain-finished artificial leather including: an artificial leather base material; and a resin layer stacked on at least one surface of the artificial leather base material, wherein the artificial leather base material contains: a fiber-entangled body of ultrafine fibers; 3 to 50 mass % of a first elastic polymer; 2.5 to 6 mass %, in terms of phosphorus atoms, of first phosphorous-based flame retardant particles having an average particle size of 1 to 10 μm; and 1 to 6 mass % of a plasticizer, and the resin layer contains: a second elastic polymer; and a total content, in terms of phosphorus atoms or in terms of hydroxyl groups, of 0 to 8 mass % of flame retardant particles having an average particle size of 1 to 10 μm and being at least one selected from the group consisting of second phosphorous-based flame retardant particles and first metal hydroxide particles. With this configuration, it is possible to obtain a grain-finished artificial leather having both a high level of flame retardancy and an excellent texture by using a non-halogen-based flame retardant in a grain-finished artificial leather that uses an artificial leather base material including a fiber-entangled body of ultrafine fibers.

It is preferable that the artificial leather base material contains 0.5 to 5 mass % of a fatty acid ester as the plasticizer, because a high level of flame retardancy and an excellent texture can be achieved. It is preferable that the artificial leather base material further contains a second metal hydroxide particles, because a high level of flame retardancy and an excellent texture can be achieved. It is preferable that a total content, in terms of phosphorus atoms or in terms of hydroxyl groups, of the first phosphorous-based flame retardant particles and the second metal hydroxide particles contained in the artificial leather base material is 2 to 6 mass %.

It is preferable that a total content, in terms of phosphorus atoms or in terms of hydroxyl groups, of the flame retardant particles contained in the resin layer is 2 to 8 mass %, because a higher level of flame retardancy can be achieved.

For the first phosphorous-based flame retardant particles or the second phosphorous-based flame retardant particles, it is preferable to use a polyphosphate, an organic metal phosphate, an organic metal phosphinate, and an organic metal phosphonate. For the first metal hydroxide particles or the second metal hydroxide particles, it is preferable to use aluminum hydroxide and magnesium hydroxide.

It is preferable that the first elastic polymer contains 60 mass % or more of a polycarbonate-based polyurethane, and the polyurethane has a 100% modulus of 0.5 to 5 MPa, because of excellent mechanical properties.

It is preferable that the second elastic polymer contains 60 mass % or more of a polycarbonate-based polyurethane, because of excellent abrasion resistance.

It is preferable that the artificial leather base material contains polyester-based fibers as the ultrafine fibers, and has an apparent density of 0.60 to 0.85 g/cm$^3$, because both fullness and a flexible texture, in particular, are provided.

Advantageous Effects of Invention

According to the present invention, it is possible to obtain a grain-finished artificial leather having both a high level of flame retardancy and an excellent texture.

DESCRIPTION OF EMBODIMENT

A grain-finished artificial leather according to the present embodiment is a grain-finished artificial leather including an artificial leather base material, and a resin layer stacked on at least one surface of the artificial leather base material. The artificial leather base material includes a fiber-entangled body of ultrafine fibers, 3 to 50 mass % of a first elastic polymer, 2.5 to 6 mass %, in terms of phosphorus atoms, of first phosphorous-based flame retardant particles having an average particle size of 1 to 10 μm, and 1 to 6 mass % of a plasticizer. The resin layer contains a second elastic polymer, and a total content, in terms of phosphorus atoms or in terms of hydroxyl groups, of 0 to 8 mass % of flame-retardant particles having an average particle size of 1 to 10 μm and being at least one selected from the group consisting of second phosphorous-based flame retardant particles and first metal hydroxide particles. Hereinafter, a grain-finished artificial leather will be described in detail, in conjunction with an exemplary production method thereof.

Examples of the fiber-entangled body of ultrafine fibers include fiber structures such as a non-woven fabric, woven fabric, knitted fabric, or the like of ultrafine fibers. Among these, a non-woven fabric of ultrafine fibers is particularly preferable because it has a high fiber density and thus has low density unevenness and high homogeneity, thus providing an artificial leather base material having excellent suppleness and fullness. In the present embodiment, a non-woven fabric of ultrafine fibers will be described in detail as a representative example of the fiber-entangled body of ultrafine fibers.

A non-woven fabric of ultrafine fibers is obtained, for example, by subjecting ultrafine fiber-generating fibers such as island-in-the-sea (matrix-domain) composite fibers to entangling treatment and then to ultrafine fiber-generating treatment. Although the present embodiment describes in detail a case where the island-in-the-sea composite fibers are used, it is possible to use ultrafine fiber-generating fibers other than the island-in-the-sea composite fibers, or to directly spin ultrafine fibers without using ultrafine fiber-generating fibers. As specific examples of the ultrafine fiber-generating fibers other than the island-in-the-sea composite fibers, any fibers capable of forming ultrafine fibers may be used without any particular limitation, including: for example, strip/division-type fibers in which a plurality of ultrafine fibers are lightly bonded immediately after spinning, and separated by a mechanical operation, to form a plurality of ultrafine fibers; and petal-shaped fibers obtained by alternately assembling a plurality of resins in a petal shape in a melt spinning process.

In production of a non-woven fabric of ultrafine fibers, first, a thermoplastic resin for forming a selectively-removable sea component (matrix component) of island-in-the-sea composite fibers, and a thermoplastic resin for forming island components (domain components), i.e., resin components for forming ultrafine fibers, of the island-in-the-sea composite fibers are melt spun and then stretched, thereby obtaining island-in-the-sea composite fibers.

As the thermoplastic resin for the sea component, a thermoplastic resin that differs from the resin for the island components in solubility in a solvent or in decomposability in a decomposition agent is selected. Specific examples of the thermoplastic resin forming the sea component include water-soluble polyvinyl alcohol-based resins, polyethylene, polypropylene, polystyrene, ethylene-propylene resins, ethylene-vinyl acetate resins, styrene-ethylene resins, and styrene-acrylic resins.

For the thermoplastic resin that defines the island components and that constitutes the resin component forming the ultrafine fibers, any resin capable of forming island-in-the-sea composite fibers and ultrafine fibers can be used without any particular limitations. Specific examples include: aromatic polyesters such as polyethylene terephthalate (PET), isophthalic acid-modified PET, sulfoisophthalic acid-modified PET, polybutylene terephthalate, and polyhexamethylene terephthalate; aliphatic polyesters such as polylactic acid, polyethylene succinate, polybutylene succinate, polybutylene succinate adipate, and polyhydroxybutyrate-polyhydroxyvalerate resin; polyamides such as polyamide 6, polyamide 66, polyamide 10, polyamide 11, polyamide 12, and polyamide 6-12; and polyolefins such as polypropylene, polyethylene, polybutene, polymethylpentene, and a chlorine-based polyolefin. These may be used alone or in a combination of two or more. Among these, PET or modified PET, polylactic acid, polyamide 6, polyamide 12, polyamide 6-12, polypropylene, and the like are preferable. In particular, PET and a modified resin such as isophthalic acid-modified PET are preferable because they have excellent shrinkability and can provide a high level of fullness. The ratio of modification in the modified PET is preferably 0.1 to 30 mol %, more preferably 0.5 to 15 mol %, further preferably 1 to 10 mol %.

Examples of the production method of the non-woven fabric of ultrafine fibers include a method in which island-in-the-sea composite fibers are melt spun to produce a web, and the web is subjected to entangling treatment, and thereafter the sea component is selectively removed from the island-in-the-sea composite fibers, to form ultrafine fibers. Examples of the production method of the web include a method in which filaments of the island-in-the-sea composite fibers that have been spun by spunbonding or the like are collected on a net, without being cut, to form a filament web, and a method in which filaments are cut into staples to form a staple web. Among these, a filament web is particularly preferable because of excellent denseness and fullness. The formed web may be subjected to fusion bonding treatment in order to impart shape stability thereto. Examples of the entangling treatment include a method in which about 5 to 100 layers of the web are placed on top of each other, and subjected to needle punching or high-pressure water jetting treatment.

Note that a filament means a continuous fiber, rather than a staple that has been intentionally cut after being spun. More specifically, a filament means a fiber other than a staple that has been intentionally cut so as to have a fiber length of about 3 to 80 mm, for example. The fiber length of the island-in-the-sea composite fibers before being subjected to ultrafine fiber generation is preferably 100 mm or more, and may have a fiber length of several meters, several hundred meters, several kilometers, or more, as long as the fibers are technically producible and are not inevitably cut during the production process. Note that some of filaments may be inevitably cut into staples during the production process by needle punching during entanglement or surface buffing.

In any of the processes until the sea component of the island-in-the-sea composite fibers is removed to form ultrafine fibers, fiber shrinking treatment such as heat shrinking treatment using water vapor may be performed, thus densifying the island-in-the-sea composite fibers to enhance the fullness.

The sea component of the island-in-the-sea composite fibers is removed by dissolution or decomposition at an appropriate stage after the web has been formed. Through such removal by decomposition or through dissolution and extraction, the island-in-the-sea composite fibers are subjected to ultrafine fiber generation, and ultrafine fibers in the form of fiber bundles are formed.

The average fineness of the ultrafine fibers is preferably 0.9 dtex or less, more preferably 0.001 to 0.9 dtex, particularly preferably 0.01 to 0.6 dtex, especially preferably 0.01 to 0.4 dtex. When the average fineness is excessively high, a non-woven fabric with insufficient denseness is obtained. On the other hand, ultrafine fibers having an excessively low average fineness tend to have poor productivity, or the ultrafine fibers tend to bundle together and increases the rigidity of the non-woven fabric. As for the average fineness, a cross section of the artificial leather in the thicknesses direction is imaged using a scanning microscope with a magnification of 2000×, to obtain a cross-sectional area of single fibers, and the fineness of a single fiber can be calculated from the cross-sectional area and the specific gravity of the resin that forms the fibers. The average fineness can be defined as an average value of the fineness of average 100 single fibers, evenly obtained from the captured image.

The thus obtained non-woven fabric of ultrafine fibers are subjected to thickness adjustment and planarization treatment, if necessary. Specifically, slicing treatment or buffing treatment is performed. Thus, a non-woven fabric that is a fiber-entangled body of ultrafine fibers is obtained. The thickness of the fiber-entangled body is not particularly limited, and is preferably about 100 to 3000 μm, more preferably about 300 to 2000 μm. The apparent density of the fiber-entangled body is preferably about 0.60 to 0.80 $g/cm^3$, more preferably about 0.65 to 0.75 $g/cm^3$, because an artificial leather base material having both fullness and a flexible texture can be obtained.

The artificial leather base material of the present embodiment further includes 3 to 50 mass % of a first elastic polymer, 2.5 to 6 mass %, in terms of phosphorus atoms, of first phosphorous-based flame retardant particles having an average particle size of 1 to 10 μm, and 1 to 6 mass % of a plasticizer. These are added into the fiber-entangled body of ultrafine fibers. The first elastic polymer, the first phosphorous-based flame retardant particles, and the plasticizer that are to be added into the fiber-entangled body may be simultaneously added as a mixture thereof to the fiber-entangled body, or each may be added in separate processes. Alternatively, one of these components may be added into the fiber-entangled body, and, thereafter, a mixture of the other two components may be added. Among these, it is particularly preferable to add a mixture of the first phosphorous-based flame retardant particles and the plasticizer after adding the first elastic polymer because a flexible texture and fullness can be easily obtained.

The first elastic polymer is added into the fiber-entangled body in order to impart rigidity and shape stability or suppleness and a high level of fullness to the artificial leather base material by restraining the ultrafine fibers.

The first elastic polymer is added, for example, by a method in which an aqueous liquid such as an emulsion of an elastic polymer such as polyurethane is impregnated into a fiber-entangled body of ultrafine fiber-generating fibers before subjecting ultrafine fiber-generating fibers to ultrafine fiber generation, or a fiber-entangled body of ultrafine fibers after subjecting ultrafine fiber-generating fibers to ultrafine fiber generation, followed by solidification. The use of an aqueous liquid such as an emulsion of an elastic polymer is preferable because of the low environmental load. Examples of the methods for impregnating an aqueous liquid of an elastic polymer into a fiber-entangled body of ultrafine fiber-generating fibers or a fiber-entangled body of ultrafine fibers include methods using a knife coater, a bar coater, or a roll coater, and a method involving dipping. In the case of using an emulsion of an elastic polymer, the elastic polymer can be agglomerated by a method in which heat treatment is performed in a drying device at 50 to 200° C., a method in which heat treatment is performed in a dryer after infrared heating, a method in which heat treatment is performed in a dryer after steam treatment, a method in which heat treatment is performed in a dryer after ultrasonic heating, or a combination of these methods.

As the first elastic polymer, elastic polymers such as rubbers and elastomers may be used without any particular limitation. Specific examples of the elastic polymers include diene-based rubbers (e.g., a butadiene rubber, an isoprene rubber, a chloroprene rubber, and a styrene-butadiene rubber), nitrile-based rubbers (e.g., a nitrile rubber and a hydrogenated nitrile rubber), acryl-based rubbers (e.g., an acrylic rubber), urethane-based rubbers (e.g., a polyether urethane rubber and a polyester urethane rubber), silicone rubbers, olefin-based rubbers (e.g., an ethylene-propylene rubber), fluorine rubbers, polystyrene-based elastomers (e.g., a styrene-butadiene block copolymer, a styrene-isoprene block copolymer, a styrene-butadiene-styrene block copolymer, a styrene-isoprene-styrene block copolymer, an acrylonitrile-butadiene-styrene copolymer, an acrylonitrile-styrene copolymer, or a hydrogenated product or epoxidized product thereof), a polyolefin-based elastomers (e.g., a copolymer of olefin and a rubber component, such as a propylene-ethylene/propylene rubber copolymer, or a hydrogenated product thereof), polyurethanes (e.g., polyether urethane, polyester urethane, polyether ester urethane, polycarbonate urethane, polyether carbonate urethane, and polyester carbonate urethane), polyester-based elastomers (e.g., a polyether ester elastomer and a polyester ester elastomer), polyamide-based elastomers (e.g., a polyester amide elastomer and a polyether ester amide elastomer), and halogen-based elastomers (e.g., a vinyl chloride-based elastomer). These may be used alone or in a combination of two or more. Among these, polyurethane is particularly preferable.

Examples of the polyurethane include various polyurethanes obtained by reacting a polymer polyol having an average molecular weight of 200 to 6000, an organic polyisocyanate, and a chain extender at a predetermined molar ratio.

Examples of the polymer polyol include polyether-based polyols such as polyethylene glycol, polypropylene glycol, polytetramethylene glycol, and poly(methyl tetramethylene glycol), and copolymers thereof; polyester-based polyols such as polybutylene adipate diol, polybutylene sebacate diol, polyhexamethylene adipate diol, poly(3-methyl-1,5-pentylene adipate)diol, poly(3-methyl-1,5-pentylene sebacate)diol, and polycaprolactone diol, and copolymers thereof; polycarbonate-based polyols such as polyhexamethylene carbonate diol, poly(3-methyl-1,5-pentylene carbonate)diol, polypentamethylene carbonate diol, and polytetramethylene carbonate diol, and copolymers thereof; and polyester carbonate polyol. If necessary, a multifunctional alcohol such as a trifunctional alcohol or a tetrafunctional alcohol, or a short-chain alcohol such as ethylene glycol may also be used. These may be used alone or in a combination of two or more. In particular, amorphous polycarbonate-based polyols, alicyclic polycarbonate-based polyols, linear polycarbonate-based polyol copolymers, polyether-based polyols, and the like are preferable because an artificial leather base material with well-balanced flexibility and fullness can be obtained.

Examples of the organic polyisocyanate include non-yellowing diisocyanates, including, aliphatic or alicyclic diisocyanates such as hexamethylene diisocyanate, isophorone diisocyanate, norbornene diisocyanate, and 4,4'-dicyclohexyl methane diisocyanate; and aromatic diisocyanates such as 2,4-tolylene diisocyanate, 2,6-tolylene diisocyanate, 4,4'-diphenyl methane diisocyanate, and xylylene diisocyanate polyurethane. If necessary, a multifunctional isocyanate such as trifunctional isocyanate or tetrafunctional isocyanate may also be used. These may be used alone or in a combination of two or more. Among these, 4,4'-dicyclohexyl methane diisocyanate, isophorone diisocyanate, 2,4-tolylene diisocyanate, 2,6-tolylene diisocyanate, 4,4'-diphenyl methane diisocyanate, and xylylene diisocyanate are preferable because of their excellent mechanical properties.

Examples of the chain extender include diamines such as hydrazine, ethylene diamine, propylene diamine, hexamethylene diamine, nonamethylene diamine, xylylene diamine, isophorone diamine, piperazine and derivatives thereof, adipic acid dihydrazide, and isophthalic acid dihydrazide; triamines such as diethylenetriamine; tetramines such as triethylene tetramine; diols such as ethylene glycol, propylene glycol, 1,4-butane diol, 1,6-hexane diol, 1,4-bis(β-hydroxyethoxy)benzene, and 1,4-cyclohexane diol; triols such as trimethylol propane; pentaols such as pentaerythritol; amino alcohols such as amino ethyl alcohol and amino propyl alcohol. These may be used alone or in a combination of two or more. Among these, because of excellent mechanical properties, it is preferable to use a combination of two or more of hydrazine, piperazine, ethylene diamine, hexamethylene diamine, isophorone diamine and derivatives thereof, and triamines such as diethylenetriamine. Monoamines such as ethylamine, propylamine, and butylamine; carboxyl group-containing monoamine compounds such as 4-amino butanoic acid and 6-amino hexanoic acid; monools such as methanol, ethanol, propanol, and butanol may be used together with the chain extender during a chain extending reaction.

In order to control the water absorption ratio, the adhesion with fibers, and the hardness of polyurethane, a crosslinked structure may be formed by adding a crosslinking agent containing, in the molecule, two or more functional groups capable of reacting with a functional group included in monomer units that form the polyurethane, such as a carbodiimide-based compound, an epoxy-based compound, an oxazoline-based compound, or a self-crosslinking compound such as a polyisocyanate-based compound and a multifunctional block isocyanate compound.

Examples of the emulsion of the polyurethane include a forcedly emulsified polyurethane emulsion that does not include any ionic group in the polyurethane skeleton and has been emulsified by adding an emulsifier; a self-emulsified polyurethane emulsion that includes an ionic group such as a carboxyl group, a sulfonic acid group, and an ammonium group in the polyurethane skeleton and that has been emulsified by self-emulsification; and a polyurethane emulsion that uses an emulsifier and an ionic group in the polyurethane skeleton in combination. Examples of the method for introducing a carboxyl group into the polyurethane skeleton include a method in which units of carboxyl group-containing diols such as 2,2-bis(hydroxymethyl)propionic acid, 2,2-bis(hydroxymethyl)butanoic acid, and 2,2-bis(hydroxymethyl)valeric acid are incorporated into the polyurethane skeleton.

As the emulsion of the polyurethane, it is preferable to use a polyurethane emulsion including 20 to 100 mass % of a forcedly emulsified polyurethane and 0 to 80 mass % of a self-emulsified polyurethane, in particular, including 30 to 100 mass % of a forcedly emulsified polyurethane and 0 to 70 mass % of a self-emulsified polyurethane, because a flexible texture can be achieved. The average dispersed particle size of the emulsion of the polyurethane is preferably 0.01 to 1 μm, more preferably 0.03 to 0.5 μm.

The polyurethane has a 100% modulus of preferably 0.5 to 5 MPa, more preferably 1 to 4 MPa, because a flexible texture can be achieved by a combined use with the plasticizer. When the 100% modulus is excessively low, the polyurethane tends to be softened when subjected to heat, and thus restrains the ultrafine fibers, resulting in a reduction in the flexible texture. When the 100% modulus is excessively high, the polyurethane tends to be hardened. It is preferable that polycarbonate-based polyurethane constitutes 60 mass % or more of the polyurethane because of excellent durability.

The ratio of the first elastic polymer contained in the artificial leather base material is 3 to 50 mass %, preferably 5 to 45 mass %, more preferably 8 to 30 mass %. When the content ratio of the first elastic polymer is less than 3 mass %, the fullness and the shape stability are reduced. When the content ratio exceeds 50 mass %, the rubber-like feel is increased, thus compromising the texture and reducing the flame retardancy.

When an emulsion of an elastic polymer is impregnated into a fiber-entangled body of ultrafine fiber-generating fibers or a fiber-entangled body of ultrafine fibers, and thereafter dried, the emulsion may migrate to the surface layer of the fiber-entangled body of ultrafine fiber-generating fibers or the fiber-entangled body of ultrafine fibers, and thus may not be uniformly added in the thickness direction. In such a case, the migration can be suppressed by, for example, adjusting the particle size of the elastic polymer in the emulsion; adjusting the type and the amount of the ionic groups of the elastic polymer; reducing the water dispersion stability by addition of an ammonium salt that undergoes a pH change at a temperature of about 40 to 100° C.; or reducing the water dispersion stability at about 40 to 100° C. by addition of a monovalent or divalent alkali metal salt or alkaline-earth metal salt, a nonionic emulsifier, an associative water-soluble thickener, an associative heat-sensitive gelling agent such as a water-soluble silicone-based compound, or a water-soluble polyurethane-based compound. If necessary, the emulsion may be allowed to migrate such that the elastic polymer is unevenly distributed on the surface. Alternatively, the elastic polymer may be present preferentially on the surface side by changing the conditions for the drying method or the addition method between the surface side and the back side.

When the ultrafine fibers form fiber bundles derived from ultrafine fiber-generating fibers, the first elastic polymer may be impregnated inside the fiber bundles, or may be attached to the outside of the fiber bundles. When the first elastic polymer is impregnated inside the fiber bundles, the texture can be adjusted as appropriate by changing the degree of restraint of the ultrafine fibers forming the fiber bundles. For example, when island-in-the-sea composite fibers are subjected to ultrafine fiber-generating treatment, the water-soluble thermoplastic resin is removed from the island-in-the-sea composite fibers, to form voids inside the ultrafine fiber bundles. In the case of adding an elastic polymer to a fiber-entangled body of ultrafine fibers including the thus formed ultrafine fiber bundles, a dispersion of the elastic polymer is likely to be impregnated between the ultrafine fibers forming the ultrafine fiber bundles by capillary action. Accordingly, the ultrafine fibers in the ultrafine fiber bundles can be more easily restrained, further enhancing the shape retainability of the fiber-entangled body including the ultrafine fiber bundles.

The first phosphorous-based flame retardant particles are a component that imparts, to the artificial leather base material, flame retardancy that achieves good self-extinguishing properties, as well as a low burn heat value and a low smoke density without generating a toxic gas during burning, and a texture with fullness. First phosphorous-based flame retardant particles having an average particle size of 1 to 10 μm achieve a synergistic effect with the plasticizer, thus imparting a high level of flame retardancy and a flexible texture with fullness to the artificial leather base material.

The first phosphorous-based flame retardant particles in the present embodiment are a phosphorus atom-containing compound that is a particulate solid at room temperature. Specific examples thereof include polyphosphates such as melamine polyphosphate, melam polyphosphate, melem polyphosphate, and ammonium polyphosphate; organic metal phosphates, organic metal phosphinates such as metal dialkyl phosphinates, and organic metal phosphonates. These may be used alone or in a combination of two or more. Among these, metal dialkyl phosphinates, polyphosphates, and ammonium polyphosphate that has been encapsulated by melamine or the like are preferable because of a high level of flame retardance effect achieved by good water resistance, good heat resistance, and a high phosphorus atom content. In addition, it is preferable that the first phosphorous-based flame retardant particles have low water-solubility, and the solubility is preferably 1% or less, because changes under a humidified atmosphere during use or in a wetted state do not occur. The melting point and the decomposition temperature are preferably 250° C. or more, more preferably 300° C. or more, because changes under a high-atmosphere during use do not occur.

The average particle size of the first phosphorous-based flame retardant particles is 1 to 10 μm, preferably 2 to 7 μm. When the average particle size is less than 1 μm, the texture of the artificial leather base material is hardened. When the average particle size exceeds 10 μm, it becomes difficult for the particles to be uniformly added into the voids of the fiber-entangled body, resulting in a reduction in the flame retardancy.

The ratio of the first phosphorous-based flame retardant particles included in the artificial leather base material, in terms of phosphorus atoms, is 2.5 to 6 mass %, preferably 3.5 to 5.5 mass %. When the content of the first phosphorous-based flame retardant particles is less than 2.5 mass % in terms of phosphorus atoms, a high level of flame retardancy cannot be achieved. When the content of the first phosphorous-based flame retardant particles exceeds 6 mass % in terms of phosphorus atoms, the suppleness is lost.

If necessary, the artificial leather base material may further contain metal hydroxide particles (second metal hydroxide particles). The second metal hydroxide particles impart, to the artificial leather base material, flame retardancy that achieves good self-extinguishing properties, as well as a low burn heat value and a low smoke density without generating a toxic gas during burning, and a texture with fullness. The second metal hydroxide particles also achieve a synergistic effect with the plasticizer, thus imparting a high level of flame retardancy and a flexible texture with fullness to the artificial leather base material.

The second metal hydroxide particles are a metal compound that includes a hydroxyl group and is a particulate solid at room temperature, and specific examples thereof include aluminum hydroxide and magnesium hydroxide. The average particle size of the second metal hydroxide particles is not particularly limited, and is preferably 1 to 10 μm, more preferably 2 to 8 μm.

As for the ratio of the second metal hydroxide particles included in the artificial leather base material, a total content, in terms of phosphorus atoms or in terms of hydroxyl groups, of the first phosphorous-based flame retardant particles and the second metal hydroxide particles is preferably 2 to 6 mass %, more preferably 2.5 to 6 mass %, particularly preferably 3.5 to 5.5 mass %.

The plasticizer is a component that imparts a texture having both suppleness and fullness to the artificial leather base material by suppressing reduction in the suppleness in the case of adding the first phosphorous-based flame retardant particles, and optionally the second metal hydroxide particles, to the fiber-entangled body. The plasticizer in the present embodiment is a liquid, viscous, wax-like, or solid oil or fatty ester that is blended in order to soften the fibers, the elastic polymer, the flame retardant particles that constitute the artificial leather base material, and to enhance the plastic deformability of the constituting fibers, elastic polymer, and flame retardant particles. Specific examples thereof include fatty acid esters, hydrocarbon-based oils such as paraffin oil, hydrocarbon-based waxes, carnauba waxes, phthalic acid esters, phosphoric acid esters, and hydroxy carboxylic acid esters. These may be used alone or in a combination of two or more. Among these, fatty acid esters are preferable in that they impart a texture having both suppleness and fullness to the artificial leather base material, and do not reduce the flame retardancy and the durability, when used in combination with the first phosphorous-based flame retardant particles, and the optionally added second metal hydroxide particles and elastic polymer.

Examples of the fatty acid esters include compounds obtained by esterification of an alcohol component and an acid component, such as monohydric alcohol esters, monohydric alcohol esters of polybasic acids, fatty acid esters of polyhydric alcohols and derivatives thereof, and fatty acid esters of glycerin. Examples of the alcohol component include methyl alcohol, isopropyl alcohol, n-butyl alcohol, isobutyl alcohol, n-octyl alcohol, 2-ethylhexyl alcohol, n-decyl alcohol, isodecyl alcohol, lauryl alcohol, isotridecyl alcohol, myristyl alcohol, cetyl alcohol, stearyl alcohol, octyl dodecyl alcohol, glycerin, sorbitan, polyoxyethylene sorbitan, polyoxyethylene sorbitol, ethylene glycol, polyethylene glycol, propylene glycol, pentaerythritol, and polyoxyethylene bisphenol A. Examples of the acid component include caprylic acid, capric acid, lauric acid, myristic acid, palmitic acid, stearic acid, oleic acid, behenic acid, coconut fatty acid, methacrylic acid, 2-ethylhexanoic acid, maleic acid, and sebacic acid.

Specific examples of the fatty acid esters include cetyl 2-ethylhexanoate, cocconut fatty acid methyl, methyl laurate, isopropyl myristate, isopropyl palmitate, 2-ethylhexyl palmitate, octyldodecyl myristate, methyl stearate, butyl stearate, 2-ethylhexyl stearate, isotridecyl stearate, methyl oleate, myristyl myristate, stearyl stearate, isobutyl oleate, sorbitan monolaurate, sorbitan monopalmitate, sorbitan monostearate, sorbitan tristearate, sorbitan monooleate, sorbitan trioleate, sorbitan monostearate, sorbitan sesquioleate, sorbitan monolaurate, sorbitan monopalmitate, polyoxyethylene sorbitan monolaurate, polyoxyethylene monopalmitate, polyoxyethylene sorbitan monostearate, polyoxyethylene sorbitan monooleate, polyoxyethylene trioleate, polyoxyethylene sorbitol tetraoleate, sorbitan monolaurate, polyoxyethylene monolaurate, polyoxyethylene monolaurate, polyethylene glycol monostearate, polyethylene glycol monooleate, polyethylene glycol distearate, polyethylene glycol bisphenol A lauric acid ester, pentaerythritol monooleate, pentaerythritol monostearate, pentaerythritol tetrapalmitate, monoglyceride stearate, monoglyceride stearate, monoglyceride palmitate, monoglyceride oleate, mono-diglyceride stearate, 2-ethylhexanoate triglyceride, monoglyceride behenate, mono-diglyceride caprate, triglyceride caprate, and lauryl methacrylate. The fatty acid ester may be used in the form of a dispersion in which a fatty acid ester is dispersed in a dispersing medium such as a water or a liquid mixture of water and a polar solvent such as alcohol. Among fatty acid esters, it is preferable to use a fatty acid ester having a melting point of about 60° C. or less, and preferably being a liquid compound at room temperature because it can impart a texture having both suppleness and fullness to the artificial leather base material, and does not reduce the flame retardancy or the durability, when used in combination with phosphorous-based flame retardant particles and metal hydroxide. It is particularly preferable to use a fatty acid ester of a fatty acid having a 12 to 18 carbon atoms and polyhydric alcohol because it can achieve a more flexible texture and fullness even when phosphorous-based flame retardant particles are added.

The ratio of the plasticizer included in the artificial leather base material is 1 to 6 mass %, preferably 2 to 5 mass %. When the content of the plasticizer is less than 1 mass %, the loss of the suppleness caused by addition of the first phosphorous-based flame retardant particles and the optionally added second metal hydroxide particles cannot be sufficiently inhibited. When the content exceeds 6 mass %, the plasticizer tends to reduce the flame retardancy, and to bleed out, thus causing stickiness or the like. When a fatty acid ester is included as the plasticizer, 0.5 to 5 mass %, preferably 1 to 3 mass % of the fatty acid ester is contained The method for adding the first phosphorous-based flame retardant particles, and optionally the second metal hydroxide particles and the plasticizer, to the fiber-entangled body is not particularly limited. Specific examples thereof include a method in which a dispersion containing the first phosphorous-based flame retardant particles, and optionally the second metal hydroxide particles and the plasticizer, is impregnated into a fiber-entangled body by dip-nipping, followed by drying. The viscosity of the dispersion to be impregnated is not particularly limited, so long as it is a viscosity that allows the dispersion to be impregnated into the fiber-entangled body. Specifically, the solution viscosity as measured by a rotational viscometer is preferably about 10 to 1000 MPa·s (millipascal-second), more preferably about 50 to 500 MPa·s.

By drying the fiber-entangled body into which the dispersion has been impregnated, the volatile components in the dispersion, such as a dispersing medium, are dried, and the first phosphorous-based flame retardant particles, and optionally the second metal hydroxide particles and the plasticizer, remain in the voids between the fibers of the fiber-entangled body. Although the drying conditions are not particularly limited, examples thereof include conditions that the fiber-entangled body is dried at 70 to 150° C. for about 1 to 10 minutes.

Thus, an artificial leather base material in which the elastic polymer, the first phosphorous-based flame retardant particles, and optionally the second metal hydroxide particles and the plasticizer, are impregnated into a fiber-entangled body is obtained. The artificial leather base material may be optionally subjected to: thickness adjustment and planarization treatment by slicing treatment or buffing treatment; or finishing treatment such as flexibilizing treatment by crumpling, softening treatment by milling, reverse seal brushing treatment, antifouling treatment, hydrophilization treatment, lubricant treatment, softener treatment, antioxidant treatment, ultraviolet absorber treatment, fluorescent agent treatment, and flame retardant treatment.

For the purpose of adjusting the fullness and the suppleness of the artificial leather base material, it is preferable to perform softening processing on the artificial leather base material. The method for softening processing is not particularly limited, and it is preferable to use a method in which the artificial leather base material is brought into close contact with an elastic sheet, and mechanically shrunk in a vertical direction (MD on production line), and then subjected to heat treatment in the shrunk state for heat setting. By employing this method, the artificial leather base material can be softened, while the smoothness of its surface is enhanced.

The thickness of the thus obtained artificial leather base material is not particularly limited, and is preferably about 100 to 3000 μm, more preferably about 300 to 2000 μm. The apparent density of the artificial leather base material is preferably 0.55 to 0.85 g/cm$^3$, more preferably 0.60 to 0.80 g/cm$^3$, because of well-balanced fullness and a flexible texture.

The grain-finished artificial leather of the present embodiment can be obtained by forming a grain-like resin layer on the artificial leather base material. The resin layer may be a single layer, or may have a stacked structure composed of a plurality of layers, including, for example, a skin layer and an adhesive layer. Note that when the resin layer has a stacked structure composed of a plurality of layers, the entire stacked structure is formed as a resin layer. The resin layer of the present embodiment contains a second elastic polymer, and a total content, in terms of phosphorus atoms or in terms of hydroxyl groups, of 8 mass % or less of flame retardant particles having an average particle size of 1 to 10 μm and being selected from the group consisting of second phosphorous-based flame retardant particles and first metal hydroxide particles.

The second elastic polymer is an elastic polymer included in the resin layer. Examples of the second elastic polymer include polyurethanes, acryl-based elastic bodies, silicone-based elastic bodies, diene-based elastic bodies, nitrile-based elastic bodies, fluorine-based elastic bodies, polystyrene-based elastic bodies, polyolefin-based elastic bodies, polyamide-based elastic bodies, and halogen-based elastic bodies. These may be used alone or in a combination of two or more. When the resin layer has a stacked structure, the layers of the stacked structure may include different types of elastic polymers. Among these, polyurethanes are preferable because of their excellent abrasion resistance and mechanical properties. The second elastic polymer may contain a colorant, an ultraviolet absorber, a surfactant, another flame retardant, an antioxidant, and the like, so long as the effects of the present invention are not impaired.

The second phosphorous-based flame retardant particles are a component that imparts, to the resin layer, a high level of flame retardancy that achieves good self-extinguishing properties, as well as a low burn heat value and a low smoke density without generating a toxic gas during burning, and the same materials as those included in the above-described artificial leather base material can be used. In the case of blending the second phosphorous-based flame retardant particles in the resin layer, the problem of the stickiness caused by bleeding-out on the surface during use as in the case of blending a liquid phosphorous-based flame retardant is less likely to occur. Moreover, it is possible to inhibit the loss of suppleness and the reduction of bendability caused by hardening of the resin layer as in the case of blending a film-forming, solid phosphorous-based flame retardant. The second phosphorous-based flame retardant particles preferably have low water-solubility, and the solubility is preferably 1% or less, because changes under a humidified atmosphere during use or in a wetted state do not occur. The melting point and the decomposition temperature are preferably 250° C. or more, more preferably 300° C. or more, because changes are less likely to occur during use under a high-temperature atmosphere.

The average particle size of the second phosphorous-based flame retardant particles is 1 to 10 μm, preferably 2 to 7 μm. When the average particle size is less than 1 μm, it becomes more difficult for the particles to be uniformly dispersed in the resin layer, resulting in a reduction in the flame retardancy. When the average particle size exceeds 10 μm, the surface properties and the bendability tend to be reduced, and the flame retardancy tends to be reduced.

The first metal hydroxide particles are a hydroxyl group-containing metal compound that is a particulate solid at room temperature, and specific examples thereof include particles of aluminum hydroxide, magnesium hydroxide, and the like. In the case of using a polyurethane as the second elastic polymer, it is particularly preferable to use aluminum hydroxide because of its high flame retardance effect.

The average particle size of the second phosphorous-based flame retardant particles or the first metal hydroxide particles is 1 to 10 μm, preferably 2 to 8 When the average particle size is less than 1 μm, the flame retardant particles are agglomerated and thus become difficult to be uniformly dispersed, as a result of which the flame retardancy is reduced. When the average particle size exceeds 10 μm, the surface area of the flame retardant is decreased, so that the flame retardancy is reduced, and the mechanical properties of the resin layer are also reduced. The average particle size of the second phosphorous-based flame retardant particles or the first metal hydroxide can be measured by a known method such as a method using a refractive index. In the case of using the artificial leather base material, a cross section of the artificial leather in the thickness direction or a cross section of the grain layer is imaged using a scanning microscope with a magnification of 1000×, and the number-average value of the diameters of average 100 flame retardant particles, evenly obtained from the captured image, is defined as the average particle size.

The total content of the flame retardant particles contained in the resin layer is 0 to 8 mass %, preferably 2 to 8 mass %, in terms of phosphorus atom and in terms of hydroxyl groups. When the total content exceeds 8 mass %, the resin layer is hardened, and is likely to form coarse grain and deep creases when bent. In addition, the physical properties such as bendability, tear strength, surface abrasion tend to be reduced.

The method for forming the resin layer on the artificial leather base material is not particularly limited. Specifically, dry forming or direct coating may be used, for example. The dry forming is a method in which a coating liquid including a colored resin for forming a grain-like skin layer is applied to a release sheet as the resin layer, followed by drying to form a film, and then the film is attached to the surface of the artificial leather base material via an adhesive layer, followed by releasing the release sheet. The direct coating is a method in which a coating liquid for forming the resin layer is directly applied to the surface of the artificial leather base material using a roll coater or a spray coater, followed by drying. In addition, a grain pattern may be formed on the resin layer by emboss processing or the like. Examples of the emboss processing include a method in which a skin layer is formed on a grained release paper having a grain pattern provided on its surface, and a method in which a grain pattern is transferred to the skin layer in an uncured state, followed by curing. The thickness of the resin layer is preferably 10 to 1000 μm, more preferably 30 to 300 μm.

Thus, the grain-finished artificial leather of the present embodiment is obtained. The apparent density of the grain-finished artificial leather of the present embodiment is preferably 0.60 to 0.85 g/cm$^3$, more preferably 0.65 to 0.80 g/cm$^3$, because a high level of fullness can be achieved. The grain-finished artificial leather of the present embodiment has both suppleness and a high level of fullness that resemble those of natural leather. Specifically, for example, the bending resistance of the grain-finished artificial leather as measured by a softness tester is preferably 3.5 mm or more, more preferably 4.0 mm or more for a thickness of 0.5 mm, and is preferably 3.0 mm or more for a thickness of 0.7 mm, and is preferably 2.5 mm or more for a thickness of 1 mm.

The grain-finished artificial leather of the present embodiment has a high level of flame retardancy, a flexible texture, and fullness, and therefore can be preferably used in applications for which a high level of flame retardancy, such as self-extinguishing properties, low smoke generation, and low heat generation, is required, including, for example, the interior furnishing of public transports such as aircrafts, vessels, and railroad vehicles, or the materials of seats or sofas and the interior furnishing such as walls in public buildings such as hotels and department stores.

EXAMPLES

Hereinafter, the present invention will be described more specifically by way of examples. It should be appreciated that the scope of the present invention is by no means limited by the examples.

Example 1

<Production of Non-Woven Fabric>

By using water-soluble thermoplastic polyvinyl alcohol (PVA) as a sea component and isophthalic acid-modified polyethylene terephthalate with a ratio of modification of 6 mol % as island components, molten resin was fed to a plurality of spinnerets for spinning set to a spinneret temperature of 260° C. and having nozzle holes arranged in parallel, the nozzle holes being capable of forming a sectional surface on which 25 island components with a uniform sectional surface area distributed in a sea component, and the molten resin was discharged from the nozzle holes. At this time, the molten resins were supplied while adjusting the pressure such that the mass ratio between the sea component and the island components satisfies Sea component/Island component=25/75.

Then, the discharged molten fibers were stretched by suction using a suction apparatus so as to provide an average spinning speed of 3700 m/min, and thereby to spin filaments of the island-in-the-sea composite fibers with a fineness of 3.3 dtex. The spun filaments of the island-in-the-sea composite fibers were continuously piled on a movable net, and then lightly pressed with a metal roll at 42° C., to suppress the fuzzing on the surface. Then, the filaments of the island-in-the-sea composite fibers were removed from the net, and allowed to pass between a grid-patterned metal roll having a surface temperature of 55° C. and a back roll. Thus, the filaments were hot-pressed with a linear load of 200 N/mm, to obtain a filament web having a basis weight of 31 g/m$^2$.

Next, eight layers of the web were stacked using a cross lapper apparatus to form a superposed web so as to have a total basis weight of 220 g/m$^2$, and an oil solution for preventing the needle from breaking was further sprayed to the web. Then, the web was needle-punched at a density of 3300 punch/cm$^2$ alternately from both sides by using 6-barb needles with a distance of 3.2 mm from the needle tip to the first barb at a punching depth of 8.3 mm. The area shrinkage due to this needle punching treatment was 70%, and the basis weight of the entangled web after the needle punching was 460 g/m$^2$.

The entangled web was allowed to pass for 30 seconds under a humidity of 50% RH at 70° C. at a take-up line speed of 10 m/min, to cause heat-moisture shrinking. The area shrinkage before and after the heat-moisture shrinking treatment was 47%. Them, as a first elastic polymer, a forcedly emulsified amorphous polycarbonate-based polyurethane having a 100% modulus of 2.5 MPa and a self-emulsified amorphous polycarbonate urethane having a 100% modulus of 3.0 MPa were mixed at a ratio of 60/40 based on polyurethane solids, and an aqueous dispersion including 1.5 mass % of ammonium sulfate was further impregnated into the entangled non-woven fabric, followed by drying at 150° C. Them, PVA was removed by dissolution by repeatedly performing dip-nipping treatment in hot water at 95° C., thereby to produce a fiber-entangled body intermediate including a non-woven fabric in which fiber bundles each including 25 ultrafine filaments with a fineness of 0.1 dtex were entangled three-dimensionally. The polyurethane content in the fiber-entangled body intermediate was 10 mass %.

Then, the fiber-entangled body intermediate was sliced into two in the thickness direction, and buffed, and thereby finished into a fiber-entangled body with a thickness of approximately 0.5 mm. The thus obtained fiber-entangled body had a thickness of 0.48 mm, a basis weight of 280 g/m$^2$, and an apparent density of 0.56 g/cm$^3$.

<Impregnation of First Phosphorous-Based Flame Retardant Particles and Plasticizer>

An aqueous dispersion containing 22 mass % of aluminum dialkylphosphinate with an average particle size of 4 μm, 2.2 mass % of fatty acid ester as a plasticizer, and 2.2 mass % of paraffin oil was prepared. Then, the aqueous dispersion was impregnated into the fiber-entangled body at a pick-up rate of 90% relative to the non-woven fabric of ultrafine fibers, followed by drying of moisture at 120° C. Then, the fiber-entangled body was shrunk by 5.0% in a vertical direction (length-wise direction) by using a shrinkage processing apparatus (sanforizing machine manufactured by Komatsubara Tekko K.K.) for treatment at a drum temperature of 120° C. in its shrinking portion, a drum temperature of 120° C. in its heat setting portion, and a transport speed of 10 m/min, thereby to obtain an artificial leather base material. The obtained artificial leather base material had a thickness of 0.50 mmm, a basis weight of 325 g/m$^2$, and an apparent density of 0.65 g/cm$^3$. In addition, the artificial leather base material contained its components at the following proportion: 8.2 mass % of the elastic polymer, 17 mass % (3.9 mass % in terms of phosphorus atoms) of the aluminum dialkylphosphinate, 1.7 mass % of the fatty acid ester, and 1.7 mass % of the paraffin oil.

<Formation of Grain Layer>

A polycarbonate-based polyurethane solution (Crisvon S-121, solid content: 30 mass %, manufactured by DIC Corporation) containing a pigment was applied onto a surface of a grained release sheet having a pattern of projections and recesses, followed by drying, thereby to form a grain layer film with a thickness of 30 μm.

Then, using a polycarbonate-based polyurethane solution (TA-205 FT, solid content 70%, manufactured by DIC Corporation) containing 15 mass % of aluminum dialkylphosphinate with an average particle size of 4 μm as second phosphorous-based flame retardant particles and 1.7 mass % of aluminum hydroxide with an average particle size of 3 μm as first metal hydroxide particles as an adhesive, the grain layer film formed on the grained release sheet was attached to the artificial leather base material. The polyurethane adhesive layer thus formed had a thickness of 60 μm. The resin layer in which the grain layer and the adhesive layer were attached to each other contained 3.4 mass % of the aluminum dialkylphosphinate in terms of phosphorus atoms and 0.43 mass % of the aluminum hydroxide in terms of hydroxyl groups, and the total content in terms of phosphorus atoms and in terms of hydroxyl groups was 3.8 mass %.

Thus, a grain-finished artificial leather having a thickness of 0.58 mm, a basis weight of 400 g/m$^2$, and an apparent density 0.69 g/m$^2$ was obtained.

<Evaluation of Grain-Finished Artificial Leather>

The obtained grain-finished artificial leather was evaluated according to the following evaluation methods.

(Bending Resistance)

The bending resistance was measured using a softness tester (leather softness measuring instrument ST 300, manufactured by MSA Engineering Systems Limited of the United Kingdom). Specifically, a predetermined ring with a diameter of 25 mm was set on a lower holder of the instrument, and thereafter, the grain-finished artificial leather was set on the lower holder.

Then, a metal pin (diameter: 5 mm) fixed to an upper lever was pressed down toward the grain-finished artificial leather. Then, the upper lever was pressed down, and the value at the time when the upper lever was locked was read. Note that the value indicated the penetration depth, and the larger the value, the suppler the leather was.

(Texture)

The grain-finished artificial leather was cut to a size of 20×20 cm, to prepare a sample. Then, the appearance of the leather when it was bent inward at the center thereof, and the appearance of the leather when it was held, were evaluated according to the following criteria.

A: When bent, the artificial leather bent with roundness, and formed dense and fine fold grain.

Furthermore, drape was excellent.

B: The artificial leather had a rubber-like texture, strong resiliency, and also poor drape.

C: The artificial leather had a texture with a significantly low level of fullness, and formed coarse grain and deep creases when bent.

(Burn Test: Self-Extinguishing Properties)

Vertical flame retardancy was measured in accordance with the burn test standard for the US aircraft interior materials, prescribed in FAR 25, Appendix F, Part 1(a)(1)(ii). Specifically, the grain-finished artificial leather was cut to a size of 50.8 mm×304.8 mm, to form a test piece. Then, the test piece was perpendicularly fixed to a sample holder of a burn test apparatus. A burner was disposed directly below an end of the test piece, and the flame from the burner was brought into contact with the test piece for 12 seconds, and, thereafter, the burn distance, the self-extinguishing time, the drop self-extinguishing time of the test piece were measured. Note that the evaluation was made for each of the artificial leather base material and the grain-finished artificial leather, and an average for n=10 was calculated for each of them.

(Smoke Test)

According to the burn test standard ASTM E 662 for the U.S. railroad, the test piece was heated/burned for 10 minutes using the burner flame and a heater with 25 kW/m$^2$, and the smoke density Ds was measured 4 minutes thereafter.

(Burn Heat Value Test)

According to the cone-calorie meter method prescribed in ISO 5660-1, the test piece was heated/burned for 10 minutes using a heater with 50 kW/m$^2$, and the gross heat value and the peak heat value were measured 2 minutes thereafter.

(Apparent Density)

In compliance with JIS L 1913, the thickness (mm) and the basis weight (g/cm$^2$) were measured, and an apparent density (g/cm$^3$) was calculated from these values.

The results of the above evaluation are shown Table 1 below.

TABLE 1

| | | | Example No. | | | | | | |
|---|---|---|---|---|---|---|---|---|---|
| | | | 1 | 2 | 3 | 4 | 5 | 6 | 7 |
| Artificial leather base material | Ultrafine fibers | Fineness (dtex) | 0.1 | 0.1 | 0.1 | 0.1 | 0.1 | 0.9 | 0.001 |
| | First elastic polymer | Content (mass %) | 8.2 | 5 | 8.2 | 8.2 | 25 | 8.2 | 8.2 |
| | First phosphorous-based flame retardant particles | Average particle size (μm) | 4 | 4 | 4 | 4 | 2 | 4 | 4 |
| | | Content in terms of phosphorus atoms (mass %) | 3.9 | 2.8 | 3.9 | 3.9 | 5.5 | 2.5 | 2.5 |
| | Second metal hydroxide particles | Average particle size (μm) | — | — | — | — | — | 1.5 | 1.5 |
| | | Content in terms of hydroxyl groups (mass %) | 0 | 0 | 0 | 0 | 0 | 2 | 2 |
| | Plasticizer | Total content of plasticizer (mass %) | 3.4 | 1.5 | 3.4 | 3.4 | 5.5 | 6 | 2 |
| | | Fatty acid ester (mass %) | 1.7 | 1.5 | 1.7 | 0 | 3 | 5 | 0.5 |
| Resin layer | Second phosphorous-based flame retardant particles | Average particle size (μm) | 4 | — | — | 4 | 4 | 4 | 4 |
| | | Content in terms of phosphorus atoms (mass %) | 3.4 | 0 | 0 | 3.4 | 3.4 | 3.4 | 3.4 |
| | First metal hydroxide particles | Average particle size (μm) | 3 | 3 | — | 3 | 3 | — | — |
| | | Content in terms of hydroxyl groups (mass %) | 0.43 | 3.7 | 0 | 0.43 | 3.7 | 0 | 0 |
| | Total of flame retardant particles | Content in terms of phosphorus atoms + Content in terms of hydroxyl groups (mass %) | 3.8 | 3.7 | 0 | 3.8 | 7.1 | 3.4 | 3.4 |

TABLE 1-continued

| | | | Example No. | | | | | | |
|---|---|---|---|---|---|---|---|---|---|
| | | | 1 | 2 | 3 | 4 | 5 | 6 | 7 |
| Evaluation results | Bending resistance | mm | 4.3 | 4.7 | 4.5 | 3.8 | 4 | 3.6 | 5 |
| | Apparent density | $g/cm^3$ | 0.69 | 0.67 | 0.67 | 0.69 | 0.75 | 0.65 | 0.75 |
| | Texture | | A | A | A | B | A | B | A |
| | Burn test (self-extinguishing properties) | Burn distance (mm) | 85 | 90 | 120 | 130 | 125 | 130 | 135 |
| | | Self-extinguishing time (sec) | 5.5 | 6.5 | 9 | 10 | 8 | 10 | 11 |
| | | Drop self-extinguishing time (sec) | 0 | 0 | 1 | 1 | 1 | 1 | 1 |
| | Smoke test | Smoke density (Ds) | 95 | 80 | 90 | 115 | 120 | 80 | 80 |
| | Burn heat value test | Gross heat value (kW · $min/m^2$) | 105 | 125 | 100 | 125 | 130 | 110 | 115 |
| | | Peak heat value ($kW/m^2$) | 315 | 335 | 300 | 330 | 330 | 290 | 310 |

TABLE 2

| | | | Comparative example No. | | | | | | | |
|---|---|---|---|---|---|---|---|---|---|---|
| | | | Com. Ex. 1 | Com. Ex. 2 | Com. Ex. 3 | Com. Ex. 4 | Com. Ex. 5 | Com. Ex. 6 | Com. Ex. 7 | Com. Ex. 8 |
| Artificial leather base material | Ultrafine fibers | Fineness (dtex) | 0.1 | 0.1 | 0.1 | 0.1 | 0.1 | 0.1 | 0.9 | 0.001 |
| | First elastic polymer | Content (mass %) | 1 | 55 | 8.2 | 8.2 | 8.2 | 8.2 | 8.2 | 8.2 |
| | First phosphorous-based flame retardant particles | Average particle size (μm) | 4 | 4 | 15 | 4 | 4 | 4 | 4 | 4 |
| | | Content in terms of phosphorus atoms (mass %) | 3.9 | 3.9 | 3.9 | 2 | 7.8 | 3.9 | 1.5 | 1.5 |
| | Second metal hydroxide particles | Average particle size (μm) | — | — | — | — | — | — | 1.5 | 1.5 |
| | | Content in terms of hydroxyl groups (mass %) | 0 | 0 | 0 | 0 | 0 | 0 | 2 | 2 |
| | Plasticizer | Total content of plasticizer (mass %) | 3.4 | 3.4 | 3.4 | 0.5 | 6.8 | 3.4 | 6 | 2 |
| | | Fatty acid ester (mass %) | 1.7 | 1.7 | 1.7 | 0.25 | 6.8 | 1.7 | 5 | 0.5 |
| Resin layer | Second phosphorous-based flame retardant particles | Average particle size (μm) | 4 | 4 | 15 | 4 | 4 | 4 | 4 | 4 |
| | | Content in terms of phosphorus atoms (mass %) | 3.4 | 3.4 | 3.4 | 3.4 | 3.4 | 6.8 | 3.4 | 3.4 |
| | First metal hydroxide particles | Average particle size (μm) | 3 | 3 | 15 | 3 | 3 | 3 | — | — |
| | | Content in terms of hydroxyl groups (mass %) | 0.43 | 0.43 | 0.43 | 0.43 | 0.43 | 1.8 | 0 | 0 |
| | Total of flame retardant particles | Content in terms of phosphorus atoms + Content in terms of hydroxyl groups (mass %) | 3.8 | 3.8 | 3.8 | 3.8 | 3.8 | 8.6 | 3.4 | 3.4 |
| Evaluation results | Bending resistance | mm | 4.5 | 3.2 | 4.4 | 4.5 | 3.3 | 3.4 | 3.8 | 5.2 |
| | Apparent density | $g/cm^3$ | 0.62 | 0.78 | 0.69 | 0.68 | 0.75 | 0.73 | 0.62 | 0.72 |
| | Texture | | C | B | A | C | A | B | B | A |
| | Burn test (self-extinguishing properties) | Burn distance (mm) | 80 | Completely burned | 220 | 240 | 80 | 85 | 210 | 210 |
| | | Self-extinguishing time (sec) | 4.5 | Completely burned | 25 | 21 | 5 | 5 | 16 | 16 |
| | | Drop self-extinguishing time (sec) | 0 | 8 | 3 | 2 | 0 | 0 | 7 | 7 |
| | Smoke test | Smoke density (Ds) | 80 | 160 | 135 | 130 | 90 | 90 | 85 | 85 |
| | Burn heat value test | Gross heat value (kW · $min/m^2$) | 80 | 220 | 115 | 125 | 120 | 115 | 115 | 120 |
| | | Peak heat value ($kW/m^2$) | 240 | 445 | 335 | 380 | 300 | 320 | 300 | 305 |

Examples 2 to 5

Grain-finished artificial leathers were obtained in the same manner as in Example 1, except that the compositions of the components in Example 1 were changed as shown in Table 1, and the obtained artificial leathers were evaluated. The results are shown in Table 1.

Examples 6 to 7

Grain-finished artificial leathers were obtained in the same manner as in Example 1, except that, as shown in Table 1, the fineness of the ultrafine fibers was changed to 0.9 dtex or 0.001 dtex, and aluminum hydroxide was contained as second metal hydroxide particles in the artificial leather base material, and a fatty acid ester and a phosphoric acid ester were used as the plasticizer contained in the artificial leather base material, and the obtained artificial leathers were evaluated. The results are shown in Table 1.

Comparative Example 1

A grain-finished artificial leather was obtained in the same manner as in Example 1, except that the content of the first elastic polymer in the artificial leather base material was changed to 1 mass % by changing the concentration of the dispersion of the elastic polymer to 2.5 mass %, and the obtained artificial leather was evaluated. The results are shown in Table 2.

Comparative Example 2

A grain-finished artificial leather was obtained in the same manner as in Example 1, except that the content of the first elastic polymer in the artificial leather base material was changed to 55 mass % by changing the concentration of the dispersion of the elastic polymer to 50 mass %, and the obtained artificial leather was evaluated. The results are shown in Table 2.

Comparative Example 3

An artificial leather base material was obtained in the same manner as in Example 1, except that the impregnation and the drying were performed with the particle size of the first phosphorous-based flame retardant particles changed to 15 μm. Further, a grain-finished artificial leather was obtained in the same manner as in Example 1, except that the second phosphorous-based flame retardant particles and the first metal hydroxide blended in the resin layer each had an average particle size of 15 μm, and the obtained artificial leather was evaluated. The results are shown in Table 2.

Comparative Example 4

A grain-finished artificial leather was obtained in the same manner as in Example 1, except that the impregnation and the drying were performed with the solid content of the first phosphorous-based flame retardant particles changed to 12 mass %, to change the content of the first phosphorous-based flame retardant particles to 2.0 mass % in terms of phosphorus atoms, and the obtained artificial leather was evaluated. The results are shown in Table 2.

Comparative Example 5

A grain-finished artificial leather was obtained in the same manner as in Example 1, except that the impregnation and the drying were performed with the solid content of the first phosphorous-based flame retardant particles changed to 40 mass %, to change the content of the first phosphorous-based flame retardant particles to 7.8 mass % in terms of phosphorus atoms, and the obtained artificial leather was evaluated. The results are shown in Table 2.

Comparative Example 6

A grain-finished artificial leather was obtained in the same manner as in Example 1, except that the content of the second phosphorous-based flame retardant particles blended in the surface resin layer was changed to 30 mass %, and the content of the first metal hydroxide to 8 mass %, to change a total content, in terms of phosphorus atoms and in terms of hydroxyl groups, to 8.6 mass %, and the obtained artificial leather was evaluated. The results are shown in Table 2.

Comparative Example 7

A grain-finished artificial leather was obtained in the same manner as in Example 6, except that the content of the first phosphorous-based flame retardant particles was changed to 1.5 mass % in terms of phosphorus atoms, and the obtained artificial leather was evaluated. The results are shown in Table 2.

Comparative Example 8

A grain-finished artificial leather was obtained in the same manner as in Example 7, except that the content of the first phosphorous-based flame retardant particles was changed to 1.5 mass % in terms of phosphorus atoms, and the obtained artificial leather was evaluated. The results are shown in Table 2.

Referring to Tables 1 and 2, each of the artificial leather base materials obtained in Examples 1 to 7 had a bending resistance of 3.6 mm or more, and had a flexible texture, as well as favorable fullness and fold creases. Moreover, the self-extinguishing properties were favorable, and the smoke generation and the burn heat value were low, and, therefore, grain-finished artificial leathers with a high level of flame retardancy were obtained. On the other hand, the grain-finished artificial leather obtained in Comparative example 1, in which the amount of the first elastic polymer was small, had insufficient fullness, and also formed poor fold creases. The grain-finished artificial leather obtained in Comparative example 2, in which the amount of the first elastic polymer was large, had a poor texture, and also had insufficient self-extinguishing properties, high smoke generation, a high burn heat value, and hence a low flame retardancy. The grain-finished artificial leather of Comparative example 3, in which the average particle size of the flame retardant particles was large, showed variations in the burn test, and had insufficient self-extinguishing properties. The grain-finished artificial leather of Comparative example 5, in which the amount of the first phosphorous-based flame retardant particles included in the artificial leather base material was large, had a reduced bending resistance, and thus had a hard texture. The grain-finished artificial leather of Comparative example 6, in which the amount of the flame retardant particles in the resin layer was large, had a reduced bending resistance, thus had a hard texture, and also formed poor fold creases. The grain-finished artificial leathers of Comparative examples 7 and 8, in which the amount of the first phosphorous-based flame retardant particles included in the artificial leather base material was small, exhibited significantly reduced self-extinguishing properties, and had high smoke generation and a high burn heat value, and thus had low flame retardancy.

INDUSTRIAL APPLICABILITY

A grain-finished artificial leather according to the present invention can be preferably used in applications for which a high level of flame retardancy is required, including, for example, the interior materials and the seats in public transports such as aircrafts, vessels, and railroad, the interior materials and the seats in public buildings such as hotels and department stores, and also the interior materials in applications for shoes, clothing, gloves, bags, balls, interior decorations, and vehicle interior parts.

The invention claimed is:

1. A grain-finished artificial leather, comprising:

an artificial leather base material; and a resin layer stacked on at least one surface of the artificial leather base material, wherein the artificial leather base material comprises a fiber-entangled body of ultrafine fibers, where the ultrafine fibers have an average fineness of 0.9 dex or less; 3 to 50 mass % of a first elastic polymer; 2.5 to 6 mass %, in terms of phosphorus atoms, of first phosphorous-based flame retardant particles having an average particle size of 1 to 10 μm; and 1 to 6 mass % of a plasticizer comprising a fatty acid ester obtained from a fatty acid having 12-18 carbon atoms and a polyhydric alcohol, and the resin layer comprises a second elastic polymer; and a total content, in terms of phosphorus atoms or in terms of hydroxyl groups, of 0 to 8 mass % of flame retardant particles having an average particle size of 1 to 10 μm and being at least one selected from the group consisting of second phosphorous-based flame retardant particles and first metal hydroxide particles.

2. The grain-finished artificial leather according to claim 1, wherein the artificial leather base material comprises 0.5 to 5 mass % of the fatty acid ester as the plasticizer.

3. The grain-finished artificial leather according to claim 1, wherein the artificial leather base material further comprises second metal hydroxide particles.

4. The grain-finished artificial leather according to claim 3, wherein a total content, in terms of phosphorus atoms or in terms of hydroxyl groups, of the first phosphorous-based flame retardant particles and the second metal hydroxide particles contained in the artificial leather base material is 2 to 6 mass %.

5. The grain-finished artificial leather according to claim 1, wherein a total content, in terms of phosphorus atoms or in terms of hydroxyl groups, of the flame retardant particles contained in the resin layer is 2 to 8 mass %.

6. The grain-finished artificial leather according to claim 1, wherein the first phosphorous-based flame retardant particles or the second phosphorous-based flame retardant particles comprise at least one selected from the group consisting of a polyphosphate, an organic metal phosphate, an organic metal phosphinate, and an organic metal phosphonate.

7. The grain-finished artificial leather according to claim 1, wherein the first metal hydroxide particles or the second metal hydroxide particles comprise at least one selected from the group consisting of aluminum hydroxide and magnesium hydroxide.

8. The grain-finished artificial leather according to claim 1, wherein the first elastic polymer comprises 60 mass % or more of a polycarbonate-based polyurethane, and the polyurethane has a 100% modulus of 0.5 to 5 MPa.

9. The grain-finished artificial leather according to claim 1, wherein the second elastic polymer comprises 60 mass % or more of a polycarbonate-based polyurethane.

10. The grain-finished artificial leather according to claim 9, wherein the ultrafine fibers have an average fineness of 0.01 to 0.6 dtex.

11. The grain-finished artificial leather according to claim 1, wherein the ultrafine fibers comprise polyester-based fibers, and the artificial leather base material has an apparent density of 0.60 to 0.85 g/cm$^3$, where the apparent density of the artificial leather base material is determined based on a thickness (mm) and a basis weight (g/cm$^2$) of the artificial leather base material measured in compliance with JIS L 1913.

12. The grain-finished artificial leather according to claim 2, wherein the artificial leather base material further comprises second metal hydroxide particles.

13. The grain-finished artificial leather according to claim 12, wherein a total content, in terms of phosphorus atoms or in terms of hydroxyl groups, of the first phosphorous-based flame retardant particles and the second metal hydroxide particles contained in the artificial leather base material is 2 to 6 mass %.

14. The grain-finished artificial leather according to claim 2, wherein a total content, in terms of phosphorus atoms or in terms of hydroxyl groups, of the flame retardant particles contained in the resin layer is 2 to 8 mass %.

15. The grain-finished artificial leather according to claim 2, wherein the first phosphorous-based flame retardant particles or the second phosphorous-based flame retardant particles comprise at least one selected from the group consisting of a polyphosphate, an organic metal phosphate, an organic metal phosphinate, and an organic metal phosphonate.

16. The grain-finished artificial leather according to claim 2, wherein the first metal hydroxide particles or the second metal hydroxide particles comprise at least one selected from the group consisting of aluminum hydroxide and magnesium hydroxide.

17. The grain-finished artificial leather according to claim 2, wherein the first elastic polymer comprises 60 mass % or more of a polycarbonate-based polyurethane, and the polyurethane has a 100% modulus of 0.5 to 5 MPa.

18. The grain-finished artificial leather according to claim 2, wherein the second elastic polymer comprises 60 mass % or more of a polycarbonate-based polyurethane.

19. The grain-finished artificial leather according to claim 18, wherein the ultrafine fibers have an average fineness of 0.01 to 0.6 dtex.

20. The grain-finished artificial leather according to claim 2, wherein the ultrafine fibers comprise polyester-based fibers, and the artificial leather base material has an apparent density of 0.60 to 0.85 g/cm$^3$, where the apparent density of the artificial leather base material is determined based on a thickness (mm) and a basis weight (g/cm$^2$) of the artificial leather base material measured in compliance with JIS L 1913.

* * * * *